US006045126A

United States Patent [19]

Brzezinski

[11] Patent Number: 6,045,126

[45] Date of Patent: Apr. 4, 2000

[54] VISE JAW AND BOLT

[76] Inventor: Stan F. Brzezinski, 2360 Shasta Way, Unit C, Simi Valley, Calif. 93065

[21] Appl. No.: 09/185,346

[22] Filed: Nov. 3, 1998

[51] Int. Cl.[7] ..... B25B 1/24

[52] U.S. Cl. ..... 269/282; 269/262; 269/240

[58] Field of Search ..... 269/282, 262, 269/240; 411/395, 403

[56] References Cited

U.S. PATENT DOCUMENTS 824,983 7/1906 Farrington ..... 411/403

4,422,629 12/1983 Carlson ..... 269/282

*Primary Examiner*—David A. Scherbel

*Assistant Examiner*—Benjamin M. Halpern

*Attorney, Agent, or Firm*—Colin P. Abrahams

[57] ABSTRACT

A vise comprises a base member, a fixed end member having a fixed and jaw thereon, and a movable end member having a movable end jaw thereon. The movable end jaw and the fixed end jaw define a space therebetween which can be increased or decreased by movement of the movable end member away from or towards the fixed end member. Fastening means are provided for respectively connecting the fixed end jaw to the fixed end member and for connecting the movable end jaw to the movable end member. The fastening means have receiving means whereby an attachment jaw can be releasably connected to at least one of the fixed end jaw and the movable end jaw.

18 Claims, 5 Drawing Sheets

VISE JAW AND BOLT

BACKGROUND OF THE INVENTION

This invention relates to vises, generally comprising a fixed jaw and a movable jaw, wherein the movable jaw can, by means of a screw, lever, cam or the like, be moved towards or away from the fixed jaw to enable a work piece or other object to be located in a space defined between the movable and fixed jaws. This work piece, or object, is firmly held within the fixed and movable jaws while being worked.

Vises are well-known tools and are applied and used in a wide variety of situations and circumstances. Simple or general home vises, when mounted on a table or workbench, can be used in multiple applications where it is desired to firmly hold an object in a stationary fixed position. In many instances, such vises require only a low level of precision, where the exact position of the work piece when located in the space between the movable and fixed jaws is not, to any great extent, critical. On the other hand, vises may also be used in machining and working objects which require very precise positioning, where high tolerance levels and mechanical exactness is essential to the process and accuracy of the job being performed. In such instances, one pair of jaws of a particular type may well be inadequate for carrying out different tasks, and it is therefore often desirable to connect inserts, or use attachments or replacements, in the vise, in order to tailor the configuration and properties of the jaws, as well as their positions, to the specific task at hand.

Various patents in the prior art describe different forms and types of vises. For example, U.S. Pat. No. 5,419,540 (Teafatiller) describes a work piece support for use in a machine tool. There is shown a work piece holder which can be installed on the jaw of a vise, the holder including a block which can be attached to the jaw and has a vertical face with a series of bores. Within these bores, work piece supports can be inserted, and these include angle supports which permit selected inclination of a work piece supporting edge which is in supporting contact with the work piece. This patent addresses the situation where the work piece must be firmly located between the movable and stationary end members of the vise at different predetermined angles, and the support means between these end members is designed for such selective inclination to properly locate the work piece in the desired position.

U.S. Pat. No. 4,078,782 teaches range jaws for milling machine vises. In this vise, which has stationary and movable end members, the movable end member has a flat elongated upper surface normal to a work piece clamping surface located on the movable member. A first accessory is provided having a Z-shaped cross-section, which has a notch on one of the legs. A second accessory member is also provided which has an L-shaped cross-section with one leg thereof resting on an upper lateral surface of the movable element of the vise. A bar is provided having a projection extending along the length thereof which engages the first and second accessory members. Means are provided to movably secure both the first and secondary accessory members to the movable element of the vise.

SUMMARY OF THE INVENTION

According to one aspect of the invention, there is provided a vise comprising: a base member; a fixed end member having a fixed end jaw thereon; a movable end member having a movable end jaw thereon, the movable end jaw and the fixed end jaw defining a space therebetween which can be increased or decreased by movement of the movable end member away from or towards the fixed end member; and fastening means for respectively connecting the fixed end jaw to the fixed end member and for connecting the movable end jaw to the movable end member, the fastening means having receiving means whereby an attachment jaw can be releasably connected to at least one of the fixed end jaw and the movable end jaw.

Preferably, the fastening means comprises a bolt member having a head portion and a shank portion, the receiving means comprising an open-ended axial bore extending through the bolt, and the head portion of the bolt does not project outside the end jaw, being wholly contained within a recess in the end jaw.

The fastening means may comprise at least one aperture in the end jaw, a registering aperture in the end member, and a bolt threadedly engagable in the apertures to fasten the end jaw to the end member. Preferably, the aperture in the end jaw comprises a wider diameter portion and a narrower diameter portion coaxial therewith, with a transition step between the wider diameter portion and the narrower diameter portion; and the bolt comprises a head portion and a threaded shank portion, wherein the threaded shank portion extends through the narrower diameter portion and into the aperture in the end member to threadedly engage the end member, the head portion of the bolt being located in its entirety within the larger diameter portion, the head portion abutting and applying pressure against the transition step in the aperture in the end jaw to firmly fasten the end jaw to the end member.

The invention may further comprise an attachment jaw attached to at least one of the fixed end member and the movable end member, and connecting means for fastening the attachment jaw to the fastening means. The connecting means may comprise at least one aperture in the attachment jaw, each aperture registering with a fastening means for the end jaw, and a bolt extending through the aperture in the attachment jaw and being received within the receiving means in the fastening means. The aperture in the attachment jaw preferably comprises a wider diameter portion and a narrower diameter portion, and a transitional step between the wider and narrower diameter portions; a bolt having a head portion and an externally threaded shank portion extends through the narrower diameter portion of the aperture in the connecting means and into the receiving means, the head portion of the bolt being entirely located within the wider diameter portion of the connecting means so that it does not project outwardly therefrom, wherein the head portion of the bolt abuts the transition step in the aperture of the attachment means to fasten under pressure the attachment means to the end jaw.

According to another aspect of the invention, there is provided a fastening device for connecting an end jaw to an end member of a vise, the fastening device comprising: a head portion; a shank portion, at least a portion of which has an external thread; a stepped portion between the head portion and the shank portion; and an axial internally threaded bore extending through the head portion and shank portion, wherein the shank portion can extend through the end jaw and threadedly engage the end member and the stepped portion can abut against the end jaw to force it into engagement with the end member.

In yet a further aspect, the invention is for a fastening system for connecting an attachment jaw to an existing tooling jaw in a vise, the fastening system comprising: a fastening device for connecting the tooling jaw to an end member of the vise; an attachment jaw for connection to the tooling jaw; and connecting means for connecting the attachment jaw to the tooling jaw, the connecting means engaging with the fastening device. Preferably, the fastening device comprises a head portion, a shank portion having an external thread thereon, a stepped portion between the head portion and the shank portion, and an axial internally threaded bore extending through the head portion and the shank portion.

In yet another aspect, the invention is a method of fastening an attachment jaw to an existing tooling jaw in a vise, the method comprising: fastening the tooling jaw to an end member of the vise with a fastening means recessed below a working face of the tooling jaw, the fastening means having receiving means in the form of an internally threaded bore; locating an attachment jaw adjacent the tooling jaw; and inserting a connecting means through the attachment jaw, the connecting means engaging the receiving means in the fastening means.

The invention relates therefore to a vise capable of connectably receiving one or more tooling jaws as attachments which are releasably secured to the stationary and movable end members. Preferably, the vise may have tooling jaws on each of the stationary and movable end members respectively, wherein an additional pair of jaws, referred to as thee attachment jaws, may be mounted on the vise and attached to the existing tooling jaws without removal thereof.

In high precision vises, such as those used with milling machines, it is sometimes advantageous or necessary to attach to the vise different sets of jaws for holding the work piece. Depending upon the work piece which is being located within the vise, certain circumstances may require hard jaws, while in other situations, soft jaws would be appropriate. Soft jaws are easy to cut (such as aluminum, soft steel), facilitate quick setup time; and are sufficiently soft so that they can also be cut with the work piece or object without the need for a special tool. Thus, the use of soft jaws may avoid the need for precision tooling and associated costs. Hard jaws are comprised of a hard steel having a Rockwell number up to or even exceeding 58–60. Where soft jaws are required, these are typically comprised of aluminum, aluminum alloys or materials with equivalent properties.

The jaws may be configured to have the necessary shape to carry out a particular task. The jaws may also be disposable and less expensive.

Interchanging the jaws, or replacing the jaws presently in the vise with those of a different hardness or other characteristics, can be an extremely time consuming operation. In high precision and machining and tooling, it is essential that the jaws located on the stationary and movable end members respectively are parallel to each other. Where a pair of jaws is removed, and another inserted, it can take a considerable amount of time and effort to ensure that the replacement jaws are sufficiently and substantially parallel for the exacting requirements and positioning of the work object. Further, replacing the original jaws requires additional effort to ensure that they are once more properly positioned.

The present invention is for a vise wherein the tooling jaws are connected to the stationary and movable end members, and replacement or different attachment jaws can be mounted on the tooling jaws while connected to the stationary and movable end members without removal of existing jaws. The invention also relates to a screw, bolt, or other type of fastening means whereby a jaw may be attached to the stationary or movable end members of a vise, the bolt being constructed and configured such that it is also able to receive attachably a further screw or bolt by means of which an additional or attachment jaw is attached thereto.

With the vise jaws and attachment means of the invention, the different attachment jaws can be secured onto the existing jaws efficiently and quickly to ensure that the attachment jaws remain completely or sufficiently parallel with the existing jaws on the end members of the vise, and that work faces of the jaws are properly perpendicular. Furthermore, once the attachment jaws have served their purpose and are no longer required, they can be simply removed, exposing the existing jaws which have remained unmoved during the procedure. Since the existing jaws have not been removed, it will be unnecessary to reset these existing jaws to make sure that they are parallel or properly positioned with respect to each other, have perpendicular work faces and ensure the effective working of any object held within the jaws of the vise.

The precise re-setting of existing jaws is often made difficult by work chips, dirt and/or grit on the vice. These interfere with easy replacement of existing jaws, since the smallest particle may distort the position of the existing jaws. This may be due to the hardness of the existing jaws. Attachment jaws, usually of softer materials, may be penetrated or absorb the chips etc., making it easier to set their position.

DETAILED DESCRIPTION OF THE PREFERRED EMBODIMENTS

Figure 1:
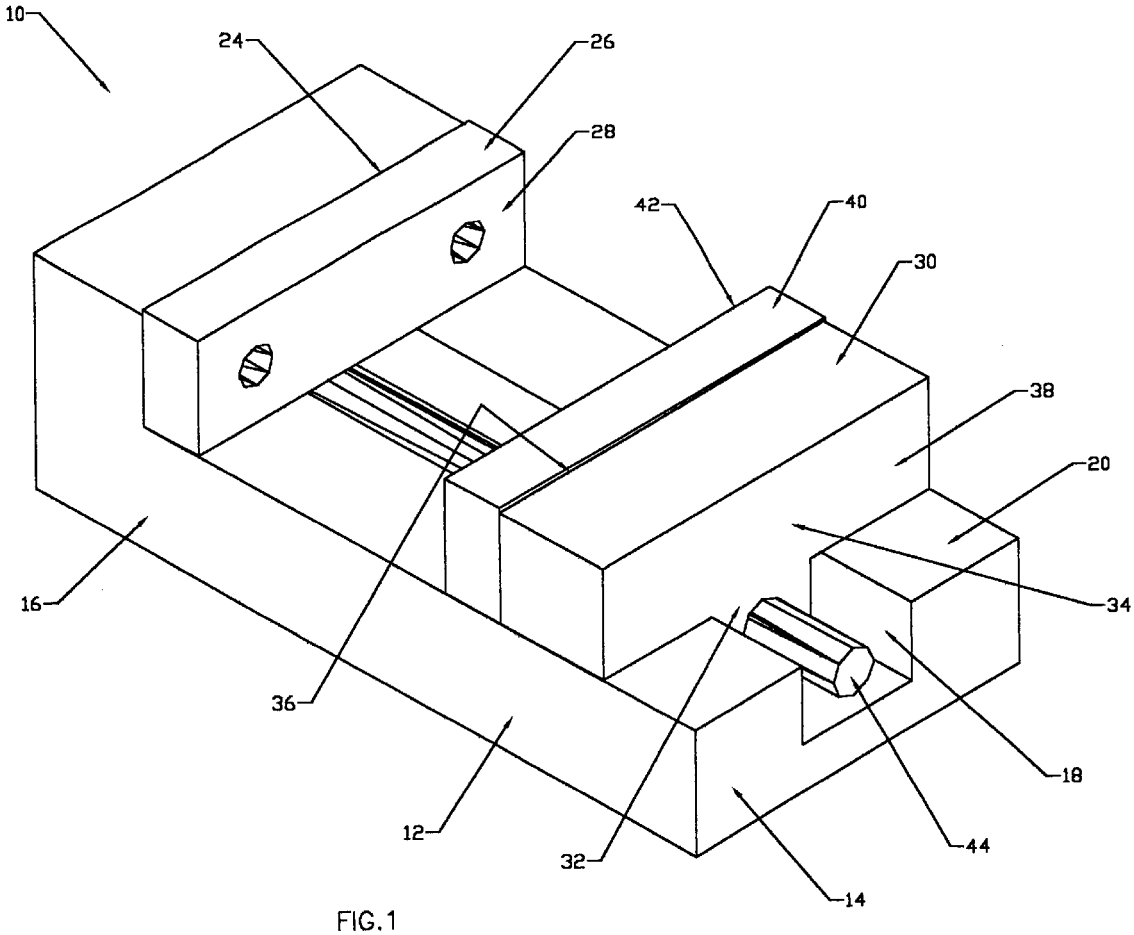
FIG. 1 is a perspective view of a conventional vise with jaws on the end members.

The invention is for a vise including a base, movable and stationary end members, and tooling (or existing) jaws mounted to the end members. In conventional fashion, the movable end member slides within a channel, or by other suitable means, with respect to the base such that the space between the movable and stationary end members either increases or decreases, and is thereby adjusted to accommodate to the size of the work piece or object located therebetween. A conventional vise is shown in FIG. 1 of the drawings, designated by reference numeral 10. The vise 10 comprises a base member 12 having a first end 14 and a second end 16. The base member 12, in this particular embodiment, has a groove 18, approximately centrally located, extending downwardly from the upper surface 20 of the base member 12.

At the second end 16, there is located a stationary end member 22, which is securely and firmly fixed to the base member 12 in any conventional fashion. The stationary end member 22 extends upwardly beyond the upper surface 20 of the base member, and has a front face 24 upon which is mounted a stationary jaw 26. The stationary jaw 26 has a smooth flat work face 28, against which a work piece or object to be clamped by the vise 10 abuts, as will be described in further detail below. The work face 28 includes the necessary holes or apertures, as illustrated, though which a bolt or screw may pass to fix the jaw to the end member 22.

The vise 10 also comprises a movable end member 30 of substantially rectangular shape, and includes a projecting leg 32 which is received within the groove 18 of the base. The dimensions of the projecting leg 32 are such that it fits snugly within the groove 18, and it is able to move axially along the length of the groove 18, at the same time moving the rectangular portion 34 of the movable end member 30 along the base. The movable end member 30 can be moved towards and away from the stationary end member 22 to thereby decrease or increase respectively the distance between the stationary and movable end members.

The movable end member 30 has a front face 36, and a rear face 38. Mounted on the front face 36 is a movable jaw 40 having a work face 42 which is substantially parallel to the work face 28 located on the stationary jaw 26. An object, or work piece, not shown, is located in the vise between the work face 28 of the stationary member 26 and the work face 42 of the movable jaw 40, and is capable of being held firmly therebetween by ensuring that the movable end member 30 is tightened and secure so that it will not move along the base.

Any conventional means may be employed for moving the movable end member 30 within the groove 18. In this particular embodiment, a threaded rod 44 is located in the groove 18, extending through a threaded aperture in the projecting leg 32 and being secured at the other end to the stationary end member 22. The rod 44 passes through a threaded aperture within the projecting leg 32, so that rotation of the rod 44, when engaging the internal threads located in an aperture within the projecting leg 32, has the effect of moving the movable end member 30 within the groove, towards or away from the stationary end member 22.

In conventional vises, such as that shown in FIG. 1, the stationary jaw 26 and movable jaw 40 are bolted to the stationary end member 22 and movable end member 30 respectively. While precision instrument vises are often constructed such that the stationary jaw 26 and movable jaw 40 can be removed from the stationary end member 22 and movable end member 30 respectively, and replaced with jaws having different characteristics and/or properties suitable and tailored to the specific task, it usually occurs that the insertion or attachment of the stationary jaw 26 and the movable jaw 40 to the stationary and movable end members 22 and 30 respectively requires a substantial amount of setting and adjustment in order to ensure that the work face 28 and the work face 42 are substantially parallel to each other. This parallelity between these work faces is essential in performing work of an exacting nature, and the proper and accurate setting is a very time-consuming task.

Figure 3:
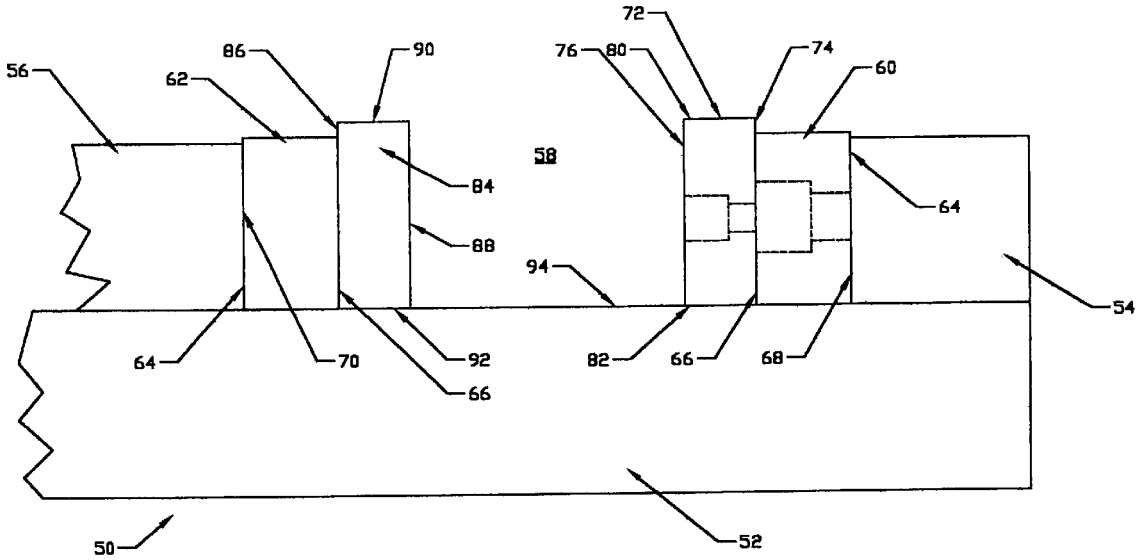
FIG. 3 is a side view of the vise of the invention showing both existing and attachment jaws fixed at each end of the vise.
Figure 5:
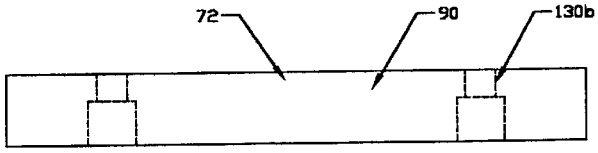
FIG. 5 is a top view of the attachment jaw of the invention.
Figure 4:
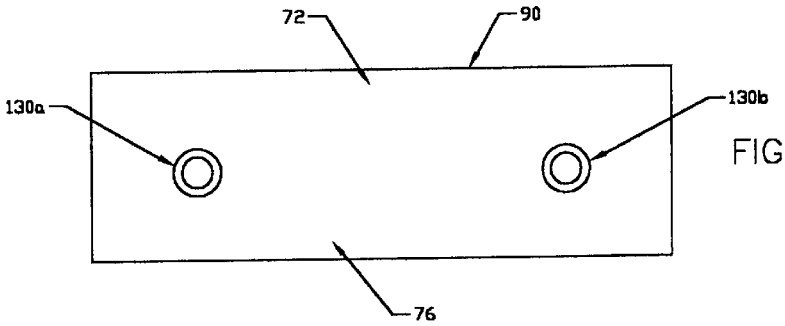
FIG. 4 is a front view of the attachment jaw of the invention.
Figure 6:
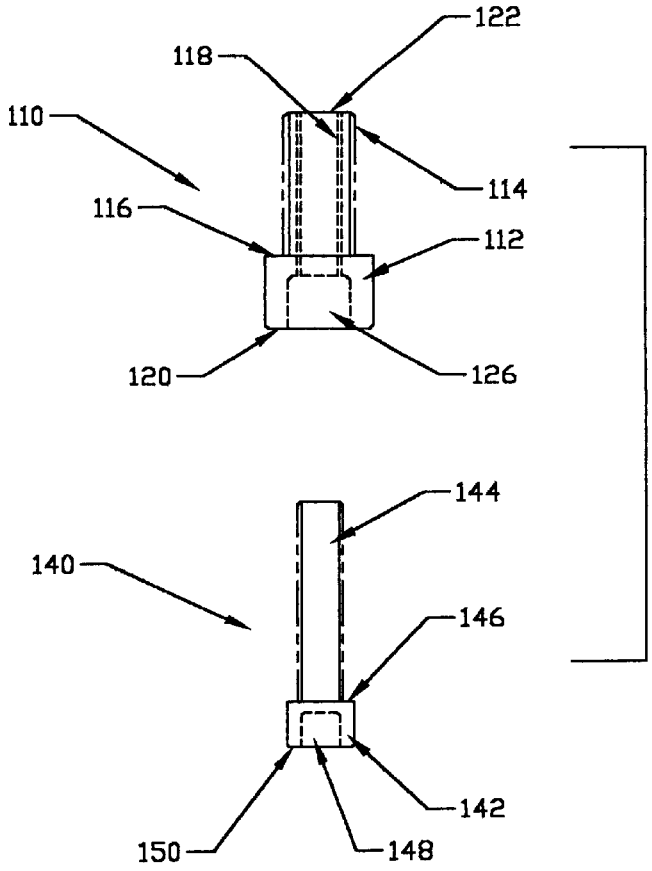
FIG. 6 is a side view of the fastening means used to secure an existing jaw to a movable end of a vise and an attachment jaw to the existing jaw.

Reference is now made to FIG. 3 of the drawings, which shows a side view of a vise including the attachment jaws and bolts of the invention. In FIG. 3, the vise of the invention is designated by reference numeral 50, and comprises a base member 52 having a fixed end member 54 and a movable end member 56. The movable end member 56 is capable of being moved along the base 52 in any suitable manner, for example, as was described with reference to FIG. 1 of the drawings. The movement of the movable end member 56 towards or away from the fixed end member 54 decreases or increases respectively the size of the space 58, in which a work piece or object is inserted.

The fixed end member 54 has attached thereto a stationary jaw 60, and the movable end member 56 has attached thereto a movable jaw 62. Both the stationary jaw 60 and the movable jaw 62 have a rear face 64 and a front face 66. The rear face 64 of the jaws 60 and 62 are flat and smooth, and flushly abut against the stationary end face 68 and movable end face 70 respectively.

An attachment jaw 72 is capable of being fixed to the stationary jaw 60. The attachment jaw 72 has a rear face 74, a front face 76, an upper end 80 and a lower end 82. The attachment jaw 72 is fixed to the stationary jaw 60 in a manner which will be described below. In a similar manner, an attachment jaw 84 is capable of being fixed to the movable jaw 62. The attachment jaw 84 has a rear face 86, a front face 88, an upper end 90 and a lower end 92.

The attachment jaw 72 is located with respect to the vice such that its rear face 74 is flat and abuts flushly against the front face 66 of the stationary jaw 60. The lower end 82 of the attachment jaw may typically rest upon the upper surface 94 of the base 52. The upper end 80 is exposed, as is the front face 76 (also the work face) of the attachment jaw 72. The front face 76 presents the surface defining the space 58, and it is to this front face 76 that an object is held in the use of the vise.

In a similar manner, the rear face 86 of the attachment jaw 84 is flat, and abuts flushly against the front face 66 of the movable jaw 62. The lower end 92 of the attachment jaw 84 rests upon the upper surface 94 of the base 52, while both the upper end 90 and the front face 88 (also the work face) are exposed. The front face 88 represents or defines one of the walls forming the space 58. An object to be held in the vice 50 will be located in the space 58 such that a part thereof lies against the front face 76. The movable end member 56 is adjusted such that it moves towards the front face 76, until the object is firmly secured and fastened between the front face 76 and the front face 88.

The stationary jaw 60 has a pair of apertures 100*a* and 100*b* (best seen in FIGS. 2 and 7) extending completely therethrough. Each aperture 100 is approximately T-shaped, and comprises a wider diameter portion 102 and a narrower diameter portion 104. A transition step 106 substantially normal to the axis of the aperture is located within the aperture 100, at the transition from the wide diameter portion 102 to the narrower diameter portion 104. In a preferred embodiment, the wider diameter portion 102 may have a contoured wall of octagonal, or other polygonal shape, which may match the shape of the bolt which it receives.

Figure 2:
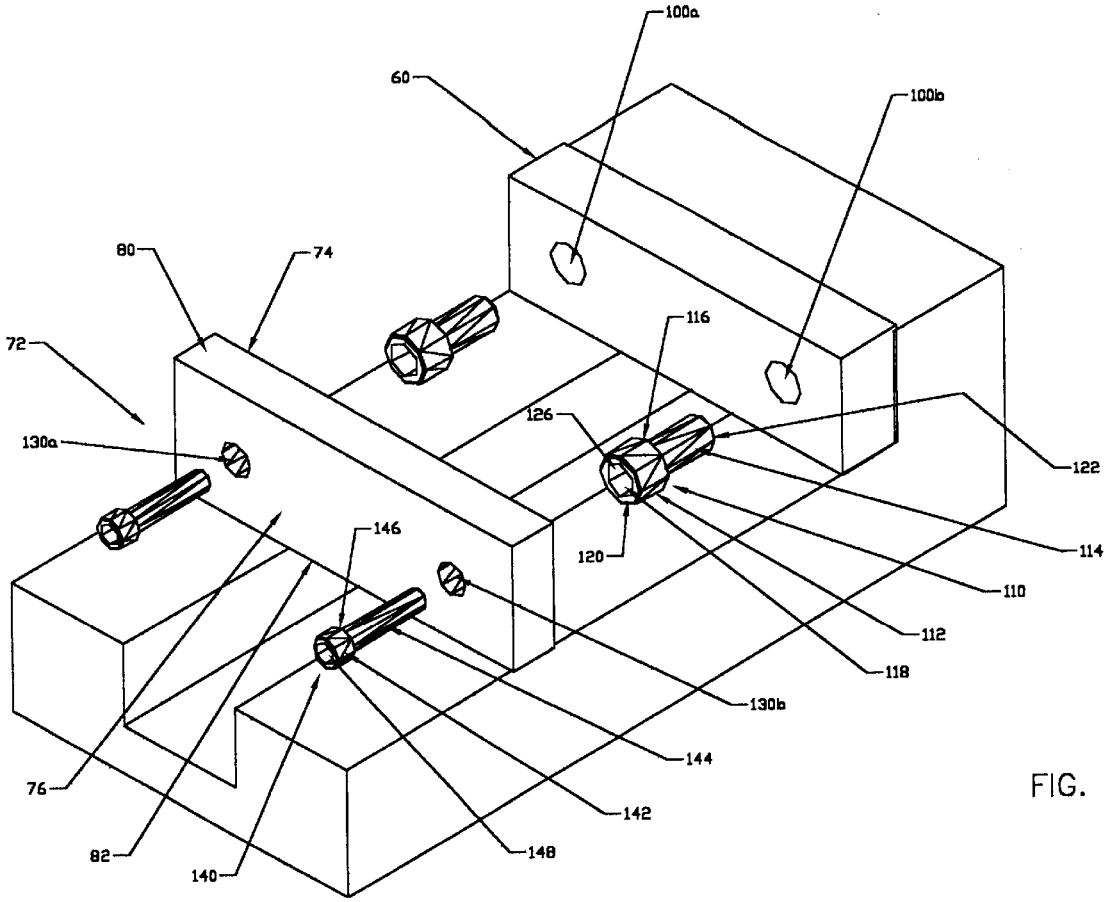
FIG. 2 is a perspective view of a vise with the attachments of the invention, showing one end only, and including the bolt of the invention.
Figure 7:
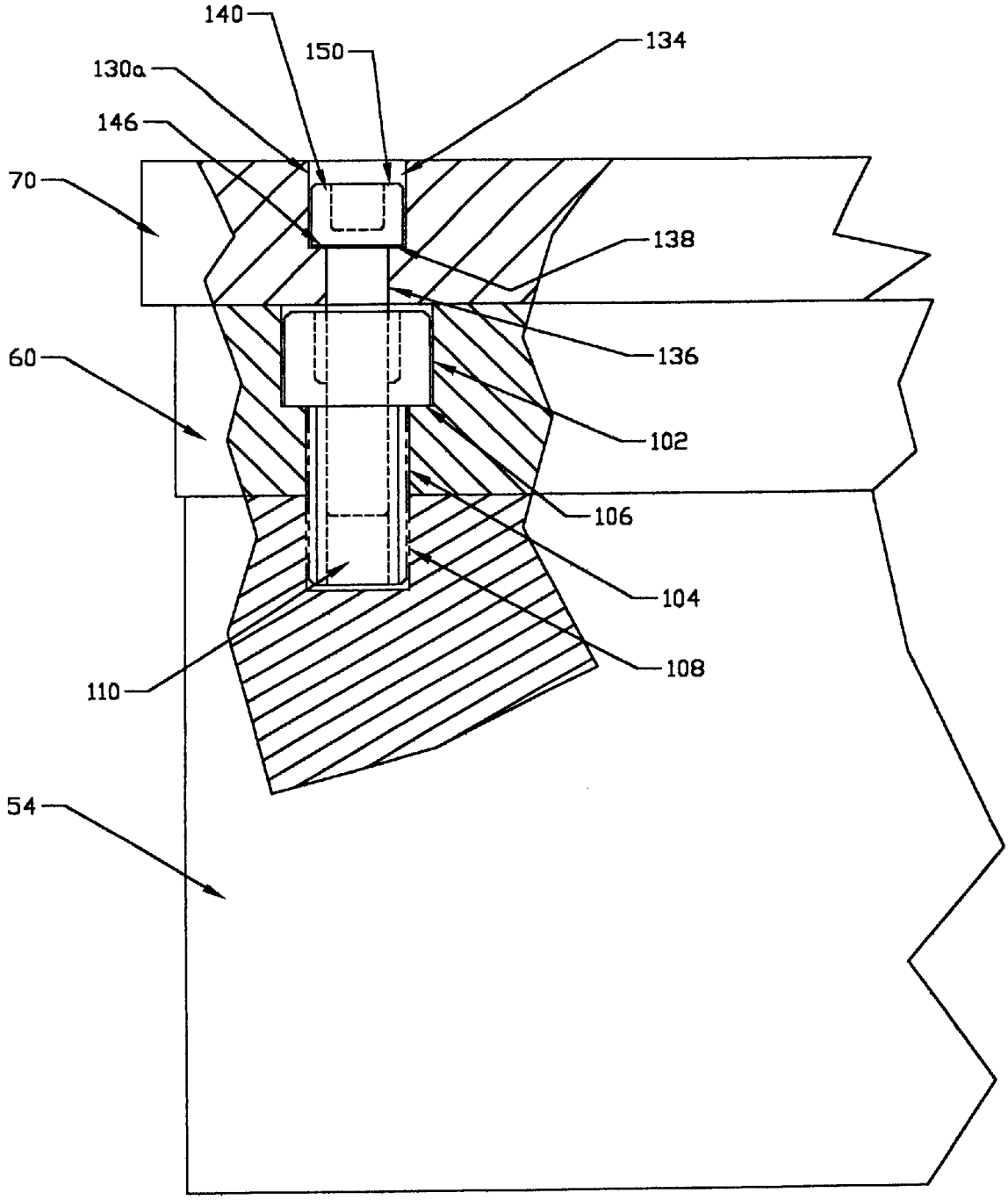
FIG. 7 is a detailed view, partially in section, showing the existing jaw and attachment jaw attached to an end of the vise with the fastening means or bolt of the invention.

The fixed end member 54 of the vice 50 includes a pair of threaded channels 108 (see for example FIGS. 2 and 7). Each threaded channel 108 communicates with, and is in direct correspondence with, the narrower diameter portion 104 of the aperture 100. Thus, when the stationary jaw 60 is placed in position against the fixed end member 54, the narrow diameter portion 104 of each of the apertures 100*a* and 100*b* will register with the threaded channel 108 in the fixed end member 54. A bolt 110 is used to fasten the stationary jaw 60 to the fixed end member 54. In use, two bolts are used, one in each of the apertures 100*a* and 100*b*. These bolts, and the fastening technique, are identical, and will thus be described only with respect to one of the apertures 100.

The bolt 110 comprises a contoured or knurled head 112 and a threaded shank 114. A step 116 defines the transition between the head 112 and threaded shank 114. The bolt 110 further includes an axial internally threaded bore 118 extending completely through the bolt 110 from the head end 120 to the shank end 122.

In use, the stationary jaw 60 is located on the vice at the fixed end member 54 such that the rear face 64 of the stationary jaw 60 is adjacent to, and abuts against the stationary end face 68 on the fixed end member 54. The position of the stationary jaw 60 is adjusted, for example, by sliding the lower end thereof over the upper surface 94 until it can be seen that the apertures 100 register and communicate with the threaded channel 108. At this point, a bolt 110 is inserted into the aperture 100. The threaded shank 114 contacts the threaded channel 108, and the bolt is then rotated so that the threaded shank engages the threaded channel 108. At the head end 120 on the bolt 110, the bore 118 terminates in an hexagonal shaped recess 126. Therefore, the bolt 110 can be easily engaged by turning it with a hex key or Allen key inserted within the hexagonal shaped recess 126. The tightening of the bolt 110 causes the bolt to move into the threaded channel 108 and the aperture 100, until such time as the step 116 on the bolt 110 reaches and abuts against the step 106 within the aperture 100. The bolt is securely turned and fastened so that the stationary jaw 60 is firmly fixed to the fixed end member 54 by the action of the bolt head 112 forcing down on the step 106. At this point, it is to be noted that the head 112 of the bolt is completely contained within the wide diameter portion 102 of the aperture 100, so that it will not in any way project or extend beyond the front face 66 of the stationary jaw 60. In fact, it is preferred that, when the bolt 110 has been completely tightened, the head end 120 will be slightly sunken and recessed a short distance below the front face 66. This ensures that the bolt 110 does not in any way interfere with or damage an object being held against the front face 66.

Figure 8:
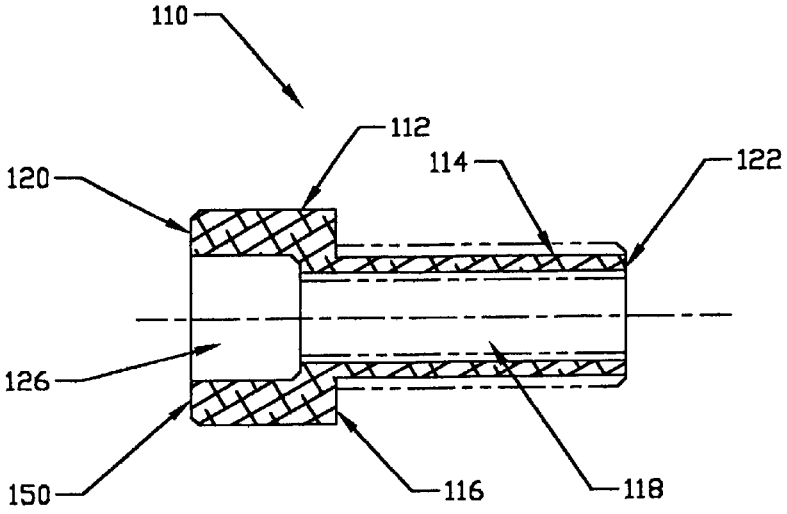
FIG. 8 is a detailed section through a bolt of the invention.

In FIG. 8, the hexagonal shaped portion or recess 126 at the end of the bore 118 can be clearly seen. The knurled or contoured configuration of the head 112 does not interfere with the ability of the bolt 110 to turn within the aperture 100. Rather, this configuration is to assist in the initial holding and positioning of the bolt 110 within the aperture 100.

The use of two bolts 110 adequately fixes and firmly holds the stationary jaw 60 to the fixed end member 54. It is also to be noted that the movable jaw 62 is affixed to the movable end member 56 in precisely the same manner, using bolts 110 of the type described above engaging within an aperture in the movable jaw, and threadably engaging a threaded channel (not shown) appropriately located in the movable end member 56. As was described with respect to the stationary jaw 60, the attachment of the movable jaw 62 to the movable end member 56 will be such that the bolt 110, and particularly the head 112 thereof, will be completely contained within the wider diameter portion and will not project beyond the front face 66 of the movable jaw 62.

When inserting the stationary jaw 60 and movable jaw 62, the positions of these jaws are very carefully monitored to ensure that they are precisely located with respect to the end members, such that the front faces 66 of the stationary jaw 60 and movable jaw 62 are substantially and/or sufficiently parallel to each other within high levels of tolerance. One of the advantages of the present invention is that these stationary and movable jaws 60 and 62 can remain on the vise relatively permanently, so that the time consuming task of precision attachment of these jaws on the vise need not be performed each time they are removed. Instead of removing the jaws, attachment jaws can be affixed to the stationary and movable jaws 60 and 62 respectively, as will be described below, thereby obviating the need for the stationary and movable jaws 60 and 62 to be removed when their properties and characteristics are not suitable for the task to be performed. In such a situation, attachment jaws are merely added, and thereafter removed, leaving the stationary and movable jaws 60 and 62 in their original position, and not requiring any further setting or adjustment.

In the invention, an attachment jaw 72 may be simply and releasably, but firmly, attached to the stationary jaw 60, and attachment jaw 84 likewise connected to the movable jaw 62. FIG. 3 shows a side view of the vise including the stationary and movable jaws, as well as the attachment jaws, and FIG. 2 of the drawings is an exploded view of the various components of the invention which clearly illustrate the manner by which the attachment jaws 72 and 84 are connected to the stationary jaw 60 and the movable jaw 62 respectively. Since both the attachment jaws 72 and 84 are connected to their respective stationary or movable jaw in precisely the same manner, the description and drawings will describe only the attachment of one such jaw.

In FIG. 2 of the drawings, the attachment of jaw 72 is illustrated, and includes a pair of apertures 130*a* and 130*b*. When the attachment jaw 72 abuts against the front face 66 of the stationary jaw 60, the apertures 130*a* and 130*b* will be axially aligned with the bore 118 in each of the bolts 110 which have been installed, and which have attached the stationary jaw to the fixed end member 54.

The attachment jaw 72 is located on the vise, with the other end 82 thereof resting upon the upper surface 94 of the base 52. The attachment jaw 72 is moved towards the stationary jaw 60, until the rear face 74 thereof is adjacent and abuts against the front face 66 of the stationary jaw 60. The attachment jaw 72 is then adjusted until the apertures 130*a* and 130*b* are aligned with the apertures 100*a* and 100*b* respectively in the stationary jaw 60. The apertures 130*a* and 130*b* in the attachment jaw 72 extend completely therethrough from the front face 76 to the rear face 74. As can be clearly seen in FIG. 7 of the drawings, the aperture 130*a* is T-shaped and comprises a wider diameter portion 134 and a narrower diameter portion 136, both of which are substantially cylindrical in shape and coaxial with each other. The wider diameter portion 134 and narrower diameter portion 136 are transitioned by a step 138 between these two portions.

A bolt 140 is designed for the purpose of attaching the attachment jaw 72 to the stationary jaw 60. The bolt 140 comprises a knurled or octagonal head 142 and a shank 144, and a transition between them defining a step 146. The shank 144 has an external thread which, as will be described below, is adapted to engage the internal thread inside the bore 118 of the bolt 110. The head 142 of the bolt 140 has a head end 150, and extending inwardly into the head 142 from the end 150 is an hexagonal shaped recess 148. The recess 148 is adapted to receive therein a hex key or Allen key to facilitate rotation thereof and easy connection of the bolt 140 to the bolt 110 as described below.

With the attachment jaw 72 properly located adjacent the stationary jaw 60, so that the bore 118 is axially aligned with the apertures 130*a* and 130*b* in the attachment jaw 72, a bolt 140 is inserted into the apertures 130*a* and 130*b*. Both bolts 140 attach to the bolts 110 in the same manner, and only one description will be given herein. As mentioned, the bore 118 of the bolt 110 includes an internal thread, which matingly engages the external thread on the shank 144. Continuing to rotate the bolt 140 causes it to move inwardly and towards the bolt 110 until such time as the head 142 becomes completely inserted within the wider diameter portion 134 of the aperture 130*a*. Tightening of the bolt can conveniently be achieved using a hex key located within the recess 148. After sufficient rotation, the step 146 on the head 142 is adjacent to and abuts the step 138 between the wider and narrower diameter portions 134 and 136 respectively. Further tightening of the bolt fixes the attachment jaw more securely and firmly against the stationary jaw 60, until the desired torque has been achieved. It is to be noted that the head 142, when fully inserted, is completely located within the wider diameter portion 134 of the aperture 130*a*. Thus, the head end 150 will not project or protrude beyond the front face 76 of the attachment jaw 72, and will not interfere with, or damage in any way, any object or work piece which is located between the movable and stationary end of the vise.

To the extent that may be necessary, any fine adjustments or precision movement required to ensure that the attachment jaw 72 is properly aligned with, and substantially parallel to, the attachment jaw 84 connected at the movable end member 56 of the vise 50 can now be undertaken.

Once the task has been performed and completed on the work piece or object which requires the particular attachment jaws 72 and 84 within the vise, the attachment jaws 72 and 84 can simply and quickly be removed by inserting a hex key into the recess 148, removing the bolt 140, and separating the attachment jaws 72 and 84 from the stationary and/or movable jaws 60 and 62. If the next task requires another specialized set of attachment jaws, such attachment jaws have the shape and configuration of that shown in, for example, FIGS. 2 and 3 of the drawings, including the apertures 130*a* and 130*b* which can be aligned with the bores 118 in bolts 110, so that easy connection of these alternative attachment jaws can be accomplished. If, on the other hand, no specialized type of attachment jaws are required, removal of the attachment jaws exposes the stationary jaw 60 and movable jaw 62 as the current operating jaws of the vise. Since these have not been previously removed or adjusted in any way by the connection and subsequent removal of the attachment jaws, they will not require any form of adjustment of realignment, thus saving significantly on the amount of time and effort required by a worker to prepare the vise for subsequent uses.

As will be appreciated, the invention greatly simplifies and expedites the process of temporarily modifying the jaws in a precision vise instrument by essentially eliminating the need to fine tune or adjust for the necessary exactness the position of the stationary and movable jaws which form a permanent part of the vise. The invention enables the vise to operate in many different contexts, according to the nature of the object being worked, without having to remove the stationary and movable jaws. Instead, the invention provides means whereby an appropriate attachment jaw can be temporarily affixed to the vise as a "piggy-back" attachment to the existing jaws, using the precisely located existing jaws as a basis for the connection.

In this invention, the attachment jaws may be reversible, in which case it is preferable if they are somewhat thicker since a wider diameter portion of the aperture is needed on both sides thereof. Further, the jaw may be designed to be cut with the object and then discarded.

The scope of the invention is such that existing vises which do not have the bolt 110 for fixing the stationary or movable jaws 60 and 62 to the end members 54 and 56 can be converted to provide a vise in accordance with the invention. Additionally, the particular attachment using the bolts and jaws as described herein can be incorporated into newly manufactured vises. In other words, the invention is for new vises incorporating the features of the invention, as well as modified existing vises which are adapted or altered to incorporate the jaws and connecting bolts of the invention.

An existing vise can be easily modified to one in accordance with the invention. For example, existing bolts (new or used vises) are removed and new bolts of the invention are inserted without removing or loosening the position of the hard jaws. This is accomplished by inserting a block of material into the vise in the center, with the two old and existing bolts exposed on each side of the block. The vise is tightened so that the jaws will stay in place after removing the old existing bolts. These bolts are removed, new bolts are tightened into position and the vise can then be opened, ready to operate and/or receive jaws.

EXAMPLE OF A PREFERRED EMBODIMENT

In a preferred embodiment, the bolt 110 is a ½-13 socket head cap screw with external thread, and a 5/16th-18 inner thread. For use with such a bolt 110, the bolt 140 is a 5/16th-18 cap screw, having an external thread. The aperture 130 has a diameter of 0.32 inches extending from the front face 76 to the rear face 74, while the wider diameter portion has a diameter of about 0.5 inches. In this preferred embodiment, the attachment jaws 72 and 84 have a height of 2 inches, and a thickness of 0.75 inches. The distance between the axes of apertures 130*a* and 130*b* is 3.875 inches in standard vises. The length of the shank 114 of the bolt 110 is preferably 1 inch. The width of the attachment from one end to the other is a minimum of 6.1 inches, depending upon the application. Preferably, the attachment jaw 72 is comprised of an aluminum alloy or an equivalent thereof, which is softer than the stationary and movable jaws 60 and 62 which may typically be manufactured from hardened steel.

The invention is not limited to the precise constructional details illustrated and described herein. Thus, any suitable means of connecting an attachment jaw to an existing stationary or movable jaw on a vise would fall within the scope of the invention. The invention can be used in most vises ranging from small to very large ones. Further, the connector for the attachment jaws need not necessarily be secured to the fastening means which hold the end jaw to the end member. In this regard, the receiving means may be separate from the fastening means and located on the vise for the purpose of receiving the connector only. There are many sizes as well as different configurations of jaws which can be used on the same mounting.

I claim:

1. A vise comprising:

a base member;

a fixed end member having a fixed end jaw thereon;

a movable end member having a movable end jaw thereon, the movable end jaw and the fixed end jaw defining a space therebetween which can be increased or decreased by movement of the movable end member away from or towards the fixed end member; and fastening means for respectively connecting the fixed end jaw to the fixed end member and for connecting the movable end jaw to the movable end member, the fastening means having receiving means whereby an attachment jaw can be releasably connected to at least one of the fixed end jaw and the movable end jaw.

2. A vise as claimed in claim 1 wherein the fastening means comprises a bolt member having a head portion and a shank portion, the receiving means comprising an axial bore in the bolt member.

3. A vise as claimed in claim 2 wherein the head portion of the bolt member does not project outside the end jaw, being wholly contained within a recess in the end jaw.

4. A vise as claimed in claim 1 wherein the fastening means comprises at least one aperture in the end jaw, a registering aperture in the end member, and a bolt threadedly engagable in the aperture of the end member to fasten the end jaw to the end member.

5. A vise as claimed in claim 4 wherein:

the aperture in the end jaw comprises a wider diameter portion and a narrower diameter portion coaxial therewith, with a transition step between the wider diameter portion and the narrower diameter portion; and the bolt comprises a head portion and a threaded shank portion, wherein the threaded shank portion extends through the narrower diameter portion and into the aperture in the end member to threadedly engage the end member, the head portion of the bolt being located in its entirety within the larger diameter portion, the head portion abutting and applying pressure against the transition step in the aperture in the end jaw to firmly fasten the end jaw to the end member.

6. A vise as claimed in claim 5 wherein the receiving means comprises an axial internally threaded bore through the bolt.

7. A vise as claimed in claim 1 further comprising an attachment jaw attached to at least one of the fixed end member and the movable end member, and connecting means for fastening the attachment jaw to the fastening means.

8. A vise as claimed in claim 7 wherein the connecting means comprises at least one aperture in the attachment jaw, each aperture registering with a fastening means for the end jaw, and a bolt extending through the aperture in the attachment jaw and being received within the receiving means in the fastening means.

9. A vise as claimed in claim 8 wherein:

the aperture in the attachment jaw comprises a wider diameter portion and a narrower diameter portion, and a transitional step between the wider and narrower diameter portions;

a bolt having a head portion and an externally threaded shank portion extends through the narrower diameter portion of the aperture in the connecting means and into the receiving means, the head portion of the bolt being entirely located within the wider diameter portion of the connecting means so that it does not project outwardly therefrom, wherein the head portion of the bolt abuts the transition step in the aperture of the attachment means to fasten under pressure the attachment means to the end jaw.

10. A vise as claimed in claim 9 wherein the fastening means for the end jaw is a bolt having a head portion and a shank, the receiving means comprising an axial internally threaded bore extending through the bolt for the end jaw, and in which the shank portion of the bolt for the attachment member is received.

11. A vise as claimed in claim 8 wherein the bolt for attaching the attachment member to the end jaw further comprises a hexagonal shaped recess in the head portion thereof to facilitate rotation of the bolt in the insertion and removal thereof.

12. A vise as claimed in claim 2 wherein the bolt comprises a hexagonal shaped recess in the head portion thereof to facilitate engagement of the bolt by a tool for easy rotation of the bolt in the insertion and removal thereof.

13. A fastening system for connecting an attachment jaw to an existing tooling jaw in a vise, the fastening system comprising:

a fastening device for connecting the tooling jaw to an end member of the vise;

an attachment jaw for connection to the tooling jaw; and connecting means for connecting the attachment jaw to the tooling jaw, the connecting means engaging with the fastening device.

14. A fastening system as claimed in claim 13 wherein the fastening device comprises a head portion, a shank portion having an external thread thereon, a stepped portion between the head portion and the shank portion, and an axial internally threaded bore extending through at least a part of the head portion and/or the shank portion.

15. A fastening system as claimed in claim 14 wherein the connecting means is received and fastened to the internally threaded bore.

16. A fastening system as claimed in claim 15 wherein the connecting means includes a head portion and a threaded shank portion which engages the internally threaded bore.

17. A fastening system as claimed in claim 16 wherein the head portion of the fastening device and the head portion of the connecting means are fully contained within a recess in the tooling jaw and attachment jaw respectively so as not to project therefrom.

18. A fastening system as claimed in claim 17 wherein the tooling jaw and the attachment jaw both comprise at least one aperture for receiving the fastening device and connecting means respectively, each aperture being T-shaped and having a narrower diameter portion through which the shank passes and a wider diameter portion, wherein the recess comprises a wider diameter portion of the aperture in which the head portion is fully contained.

* * * * *